United States Patent [19]

Konishi

[11] 4,041,915

[45] Aug. 16, 1977

[54] APPARATUS TO CONTROL THE RECIRCULATION OF EXHAUST GASES INTO THE INTAKE PASSAGE IN AN INTERNAL COMBUSTION ENGINE

[75] Inventor: Hideki Konishi, Tokyo, Japan

[73] Assignee: Nissan Motor Company Limited, Yokohama City, Japan

[21] Appl. No.: 648,139

[22] Filed: Jan. 12, 1976

[30] Foreign Application Priority Data

Jan. 14, 1975 Japan ..... 50-5976

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,768,452 | 10/1973 | Lewis | 123/119 A |
| 3,834,366 | 9/1974 | Kingsbury | 123/119 A |
| 3,885,537 | 5/1975 | Diehl | 123/119 A |
| 3,930,475 | 1/1976 | Lewis et al. | 123/119 A |
| 3,977,381 | 8/1976 | Fusikawa et al. | 123/119 A |
| 3,982,515 | 9/1976 | Bradshaw | 123/119 A |

*Primary Examiner*—Wendell E. Burns

[57] ABSTRACT

A diaphragm assembly operates to open an exhaust gas recirculation control valve when the suction in the intake manifold decreases at a predetermined rate with respect to time as during acceleration.

5 Claims, 7 Drawing Figures

APPARATUS TO CONTROL THE RECIRCULATION OF EXHAUST GASES INTO THE INTAKE PASSAGE IN AN INTERNAL COMBUSTION ENGINE

This invention relates generally to a device or an apparatus to control recirculation of a portion of the exhaust gases emitted from an internal combustion engine to its intake manifold and more particularly to an apparatus in which the exhaust recirculation takes place during the engine acceleration, while recirculation of exhaust gases is blocked or greatly reduced during other driving modes such as idle, cruise and deceleration.

While exhaust gas recirculation into the intake manifold is highly efficient to reduce formation of nitrogen oxides, it is generally known that if the recirculation takes place throughout all driving modes of the engine, the engine output performance is reduced and an increased fuel consumption is entailed. This is significant in rotary piston engines, which inherently require somewhat larger fuel consumption than conventional reciprocating piston engines and the like.

In practice, an increased amount of nitrogen oxides is produced when the suction in the intake manifold is abruptly decreased with the throttle valve fully opened as at acceleration, whilst the amount of nitrogen oxides produced at idle, cruise and deceleration would not cause a serious environmental pollution problem. In order to minimize production of nitrogen oxides but maintaining a good performance and fuel economy of the engine, it is therefore desirable to carry out the exhaust gas recirculation at a controlled rate only during acceleration, cutting out or limiting the exhaust recirculation volume to a minimum during other driving modes. This again applies particularly to the rotary piston engines, in which the production of nitrogen oxides is relatively low in comparison with the other types of internal combustion engines, the exhaust recirculation only at acceleration satisfactorily reduces the production of the nitrogen oxides throughout all the driving modes. Of course, however, this invention may be advantageously applied to any of the other types of internal combustion engines for high efficiency of reducing the formation of nitrogen oxides.

It is therefore a general object of this invention to provide an exhaust recirculation control apparatus for use in an internal combustion engine of any type, which efficiently reduces formation of nitrogen oxides with minimum influence on the output performance of the engine, fuel economy and life of some of the engine parts.

Another object of this invention is to provide an apparatus of the aforementioned character in which an appropriately controlled volume of exhaust gases is recirculated to the intake manifold during acceleration of the engine with an abrupt decrease in the intake manifold suction, while cutting out or reducing the recirculation volume at other running modes of the engine.

A specific object of this invention is to provide a valve in an exhaust recirculation passage connecting the exhaust manifold to the intake manifold for limiting the flow of exhaust gas, which valve opens in response to the intake manifold suction falling at a predetermined rate with respect to time to allow the exhaust gas flow through the recirculation passage.

Another specific object of this invention is to provide a valve of the above character which is automatically closed when a preselected length of time has elapsed after the valve has fully opened.

These and other objects and advantages of the invention will become clear from the following detailed description of the invention taken in connection with the drawings, wherein like and corresponding parts are indicated by the like reference numerals throughout the several Figures and wherein.

Figure 4:
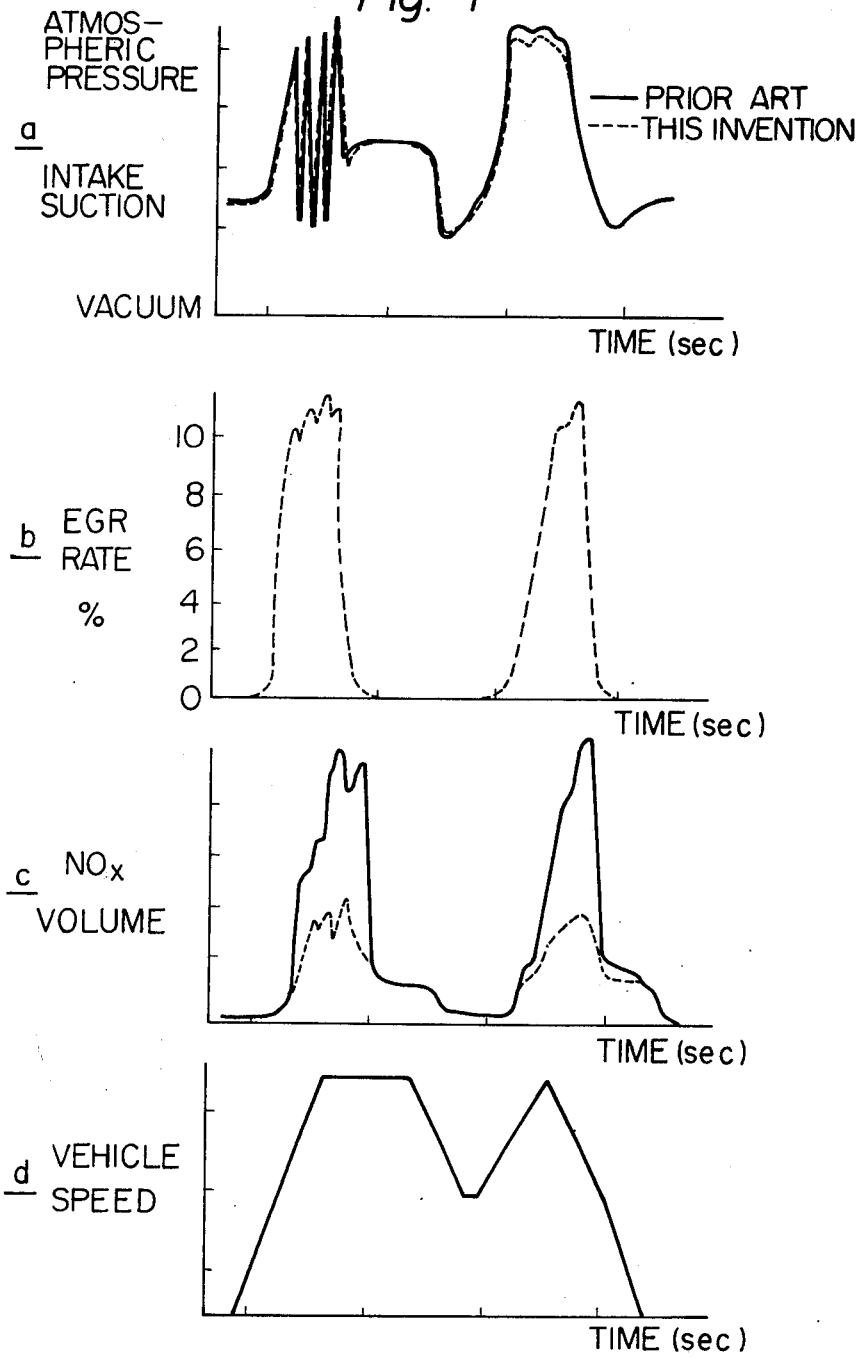

FIGS. 4 *a, b, c* and *d* are graphs illustrating the control characteristics obtained by an apparatus according to this invention.

Figure 1:
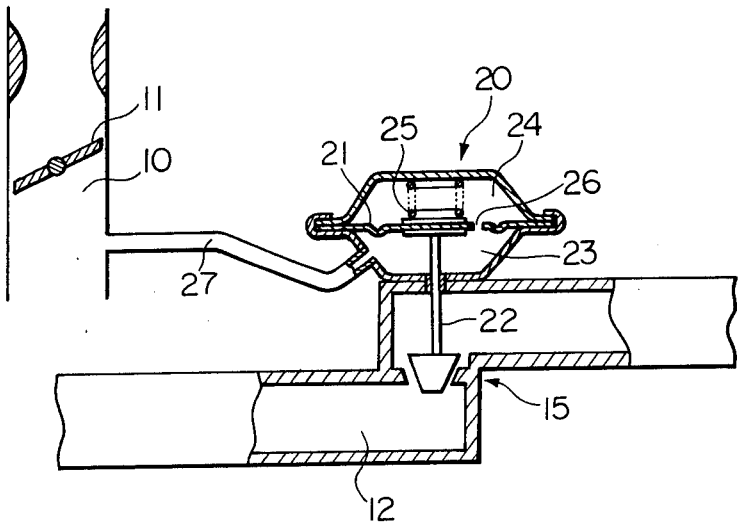
FIG. 1 is a sketch of a first preferred embodiment of this invention.

In FIG. 1 shown are the intake passage 10 leading to a manifold of an engine (not shown), a butterfly throttle valve 11 in the intake passage 10, and an exhaust recirculation passage 12 connecting the engine exhaust passage (not shown) to the intake passage 10.

An exhaust recirculation control valve 15 is disposed in the passage 12 to control the flow of exhaust gas therethrough. The valve 15 is operated by a suction responsive motor or diaphragm assembly 20, the diaphragm 21 of which is connected to the stem 22. The diaphragm 21 partitions its diaphragm housing (no number) into two suction chambers, one of which, 23, communicates with the intake passage 10 downstream of the throttle valve 11 through a pipe 27. Another chamber 24 accommodates a preloaded spring 25 which urges the diaphragm 21 in a direction tending to close the valve 15. The two chambers 23 and 24 communicate with one another through an opening 26 formed through the diaphragm 21, the size of which is appropriately selected as will be later described.

In operation, during normal cruising, the intake manifold suction conveyed to the chamber 23 is prevalent also in the chamber 24 due to fluid communication through the opening 26. Thus, the valve 15 is closed by the action of the spring 25 to block exhaust gas flow through the passage 12.

As soon as the intake manifold suction abruptly drops with the throttle valve fully opening, the suction in the chamber 23 is also reduced abruptly. On the other hand, the restricted communication through the opening 26 between the chambers 23 and 24 does not permit an immediate drop in the suction in the chamber 24 so that a substantial suction is maintained for some time in the chamber 24, providing a pressure difference between the two chambers. When the rate of variation of the pressure difference with respect to time exceeds a certain value, that is, when the suction in the chamber 23 is reduced at a predetermined rate with respect to time, for instance 50 mmHg/min., it is made to coincide with the preload of the diaphragm 21 is moved upwardly in the drawing to open the valve 15. Consequently, the volume of exhaust gas controlled by the valve 15 is fed into the intake manifold 10 through the passage 12. The valve 15 is held open for a certain period of time which is appropriately determined by selecting the size of the opening 26 and the volume of the chamber 24, and thereafter it is closed. The exhaust volume may be controlled additionally by a constant-area restriction (no number) provided in the passage 12, if desired.

Upon deceleration from cruising to low speed, the throttle valve is abruptly moved toward the closed position so that a high suction is developed in the intake manifold 10 and conveyed to the chamber 23. Since the suction in the chamber 24 is yet relatively low, a pressure difference is developed across the diaphragm 21 which together with the action of the spring moves the diaphragm to close the valve 15. No exhaust recirculation therefore takes place through the passage 12.

Figure 2:
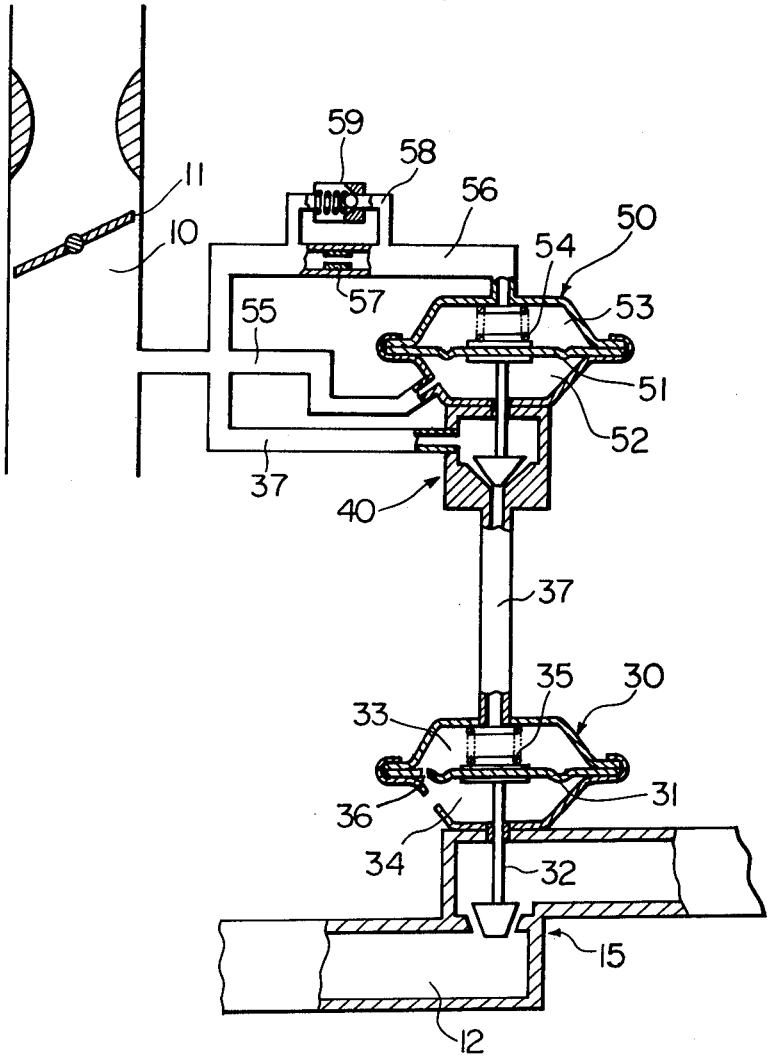
FIG. 2 is a sketch of a second preferred embodiment of this invention.

In FIG. 2, a suction actuated motor or diaphragm assembly 30 comprises a suction chamber 33 and an air pressure chamber 34, the latter freely opening to the ambient atmosphere. The two chambers are in communication with one another through a small opening 36 formed through the diaphragm 31. The spring 35 urges the diaphragm 31 at a preload to close the recirculation control valve 15, like in the first embodiment of the invention described above.

A suction pipe 37 connects the suction chamber 33 to the intake passage 10. Disposed in the pipe 37 is a suction regulating valve 40 which controls conveyance of the suction from the intake passage to the chamber 33. The suction regulating valve 40 is operable by another suction actuated motor or diaphragm assembly 50 with a spring-loaded diaphragm 51 connected to the valve 40. The diaphragm assembly 50 comprises two suction chambers 52 and 53 separated by the diaphragm 51. While the chamber 52 is directly connected with the intake passage by means of a first conduit 55, the chamber 53 communicates with the intake passage 10 by way of a restriction orifice 57 provided in a second conduit 56. The second conduit 56 further has a by-pass 58 by-passing the orifice 57 in which a one-way valve 59 of ball and spring type is accommodated to allow the flow of fluid only in a direction from the chamber 53 to the intake manifold.

This embodiment of invention operates as follows. In average running condition of the engine at cruising speed, the suction pressure conveyed to the chambers 52 and 53 respectively through the conduits 55 and 56 is substantially the same, accordingly the suction regulating valve 40 is closed by load of the spring 54. Since no suction is transferred to the chamber 33, the atmospheric pressure admitted into the chamber 33 through the opening 36 is maintained therein, no pressure difference existing across the diaphragm. The valve 15 is therefore closed by the load of spring 35 acting on the diaphragm, to prevent the flow of exhaust gas through the passage 12.

During acceleration, the suction in the chamber 52 abruptly falls in accordance with the suction drop in the intake passage suction, whereas the suction in the chamber 53 is only gradually reduced because of the restriction orifice 57. The one-way valve 59 is kept closed in this condition. As a result, a pressure difference is produced across the diaphragm 51. When the pressure difference rises to be equal to or greater than the preset load of the spring 54 for a certain length of time, the diaphragm 51 overcomes the spring force to open the suction regulating valve 40. The intake manifold suction is then conveyed through the pipe 37 via the open valve 40 into the chamber 33, hence the diaphragm 31 is moved upwardly in the drawing opening valve 15 to allow the exhaust gas through the recirculation passage 12.

As the opening degree of the throttle valve 11 is reduced for deceleration, the suction in the chamber 52 rises and at the same time the suction in the chamber 53 is likewise increased because the one-way valve 59 is now open. The valve 40 is therefore urged to close and block transfer of suction to the chamber 33. Exhaust recirculation does not take place in this condition.

After the transient acceleration has been completed, the suction applied to the chamber 33 is gradually reduced through small opening 36 in the diaphragm so that the valve 15 closes preventing the exhaust gas recirculation in any operating mode other than acceleration. The size of the opening 36 should be as small as possible within the limit that the suction in the chamber 33 is purged in an appropriate length of time. If the opening 36 is too large, the suction in the chamber 33 would be purged too rapidly to a level insufficient to open the valve 15.

This preferred embodiment is particularly advantageous in that since the recirculation control valve is operable by a relatively great difference between the atmospheric pressure and the intake manifold suction, the load of the spring 35 can be set to a correspondingly relatively large value, so that the valve 15 is closed most tightly.

Figure 3:
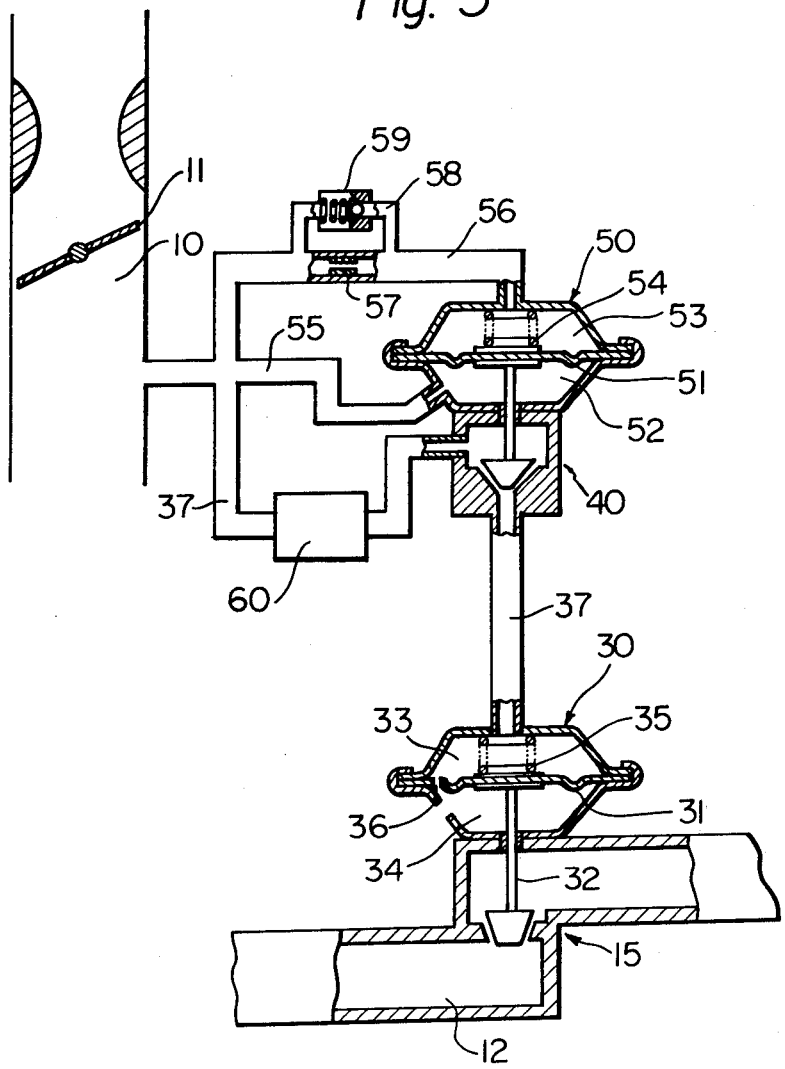
FIG. 3 is a sketch of a third preferred embodiment of this invention.

As has been previously described with respect to FIG. 2, the recirculation control valve 15 is caused to open by virtue of the intake manifold suction conveyed to the chamber 33 during acceleration. Since the intake suction at acceleration is considerably low, it may be desired to amplify the intake suction to the degree sufficient to completely open the value 15 against the action of the spring 35. FIG. 3 shows the third preferred embodiment of this invention which incorporates an expedient to increase the intake suction at acceleration applied to the chamber 33. As shown, a reservoir or accumulator 60 is placed in the suction pipe 37 between the intake passage and the suction regulating valve 40. The reservoir 60 serves to accumulate higher suction produced in the intake manifold during deceleration or cruising. At acceleration, the accumulated suction is conveyed to the chamber 33 which suction is sufficient to open the valve 15 in quick and accurate response to the acceleration condition.

FIG. 4 reveals the results of experiments conducted by the inventor, by driving vehicles which are equipped with rotary engines with the exhaust recirculation control apparatus according to this invention. When the vehicles have been running with the operation characteristics as depicted by the graphs *a* and *d* in terms of the intake manifold suction and the vehicle speed with respect to time, the exhaust recirculation rate or volume shown in *b* has been obtained by employment of a control apparatus according to this invention. As a result, the amount of produced nitrogen oxides has been reduced to the level indicated by the broken line of graph *c,* which is considerably lower than that produced by an engine with no exhaust recirculation control as represented by the solid line.

Any preferred embodiment of this invention thus enables significant reduction of formation of nitrogen oxides with minimized undesirable influences on the output performance and fuel economy of the engine, particularly when employed with rotary piston engines. The exhaust gas recirculation often causes shortening the life of some of the engine parts. This is mostly eliminated by this invention since the recirculation is carried out only at acceleration.

What is claimed is:

1. An exhaust gas recirculation control apparatus for an internal combustion engine having an exhaust passage for conducting exhaust gases from the engine, an intake passage for conducting a combustible mixture to the engine and a throttle valve in the intake passage, comprising a connecting passageway connecting the exhaust passage to the intake passage, valve means for controlling the flow of exhaust gases through the connecting passageway, a suction responsive motor having a diaphragm connected to said valve means, a first pressure chamber communicating with the intake passage downstream of the throttle valve, a second pressure chamber, the diaphragm being between said two pressure chambers, said diaphragm being preloaded by a spring to close said valve means and acted upon by the pressure difference between the pressures in the two chambers to hold the valve means in an open position when the differential pressure across the diaphragm increases at a predetermined rate with respect to time and means to provide a limited fluid communication between the two pressure chambers.

2. An apparatus as claimed in claim 1, in which said means to provide a limited fluid communication includes an opening formed through the diaphragm.

3. An apparatus as defined in claim 1, in which said second pressure chamber communicates with the ambient atmosphere, and further comprising a pressure regulating valve means disposed between said first pressure chamber and the intake passage to prevent the suction in the intake passage from being applied to the first pressure chamber and a pressure regulating valve actuating means responsive to the suction in the intake passage downstream of the throttle valve to open the pressure regulating valve means when the suction decreases at a predetermined rate with respect to time.

4. An apparatus as defined in claim 3, in which said pressure regulating valve actuating means comprises a suction responsive motor having a first suction chamber, a conduit connecting the first suction chamber to the intake passage, a restriction in said conduit, a by-pass by-passing said restriction of said conduit, a one-way valve in said by-pass to allow fluid flow only in the direction from the first suction chamber to the intake passage, a second suction chamber directly communicating with the intake passage downstream of the throttle valve, and a diaphragm between said two suction chambers and connected to the pressure regulating valve means, said diaphragm being preloaded by a spring to close the pressure regulating valve means and acted upon by the pressure difference between the pressure in the two suction chambers to open the pressure regulating valve means when the differential across the diaphragm increases at a predetermined rate with respect to time.

5. An apparatus as defined in claim 3, further comprising a suction reservoir means located between the intake passage and the pressure regulating valve means.

* * * * *